US010979799B2

(12) United States Patent
Shi

(10) Patent No.: US 10,979,799 B2
(45) Date of Patent: Apr. 13, 2021

(54) SPEAKER BOX

(71) Applicant: AAC Technologies Pte. Ltd., Singapore (SG)

(72) Inventor: Yang Shi, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,547

(22) Filed: Dec. 4, 2019

(65) Prior Publication Data

US 2020/0204906 A1 Jun. 25, 2020

(30) Foreign Application Priority Data

Dec. 25, 2018 (CN) ..... 201822192131.0

(51) Int. Cl.
*H04R 1/02* (2006.01)
*H04R 1/28* (2006.01)

(52) U.S. Cl.
CPC ..... *H04R 1/2803* (2013.01); *H04R 1/025* (2013.01)

(58) Field of Classification Search
CPC ..... H04R 1/02; H04R 1/025; H04R 1/2803; H04R 1/288; H04R 1/2819; H04R 1/2842; H04R 1/2857; H04R 1/2865; H04R 1/2873; H04R 1/2876; H04R 1/2888; H04R 2499/11
See application file for complete search history.

(56) References Cited

U.S. PATENT DOCUMENTS 8,913,738 B2 * 12/2014 Qingshan ..... H04M 1/035 379/433.02
2017/0070796 A1 * 3/2017 Miao ..... H04R 1/025
2017/0208386 A1 * 7/2017 Yang ..... H04R 9/06

FOREIGN PATENT DOCUMENTS

CN 207720403 B1 8/2018

OTHER PUBLICATIONS

PCT search report dated Feb. 3, 2020 by SIPO in related PCT Patent Application No. PCT/CN2019/113320 (8 Pages).

* cited by examiner

*Primary Examiner* — Kile O Blair
(74) *Attorney, Agent, or Firm* — W&G Law Group LLP

(57) ABSTRACT

The present invention provides a speaker box, which includes a housing with an accommodating space and a sound unit accommodated in the housing. The sound unit divides the accommodating space into a front cavity and a rear cavity. The housing is provided with a sound hole, the front cavity is communicated with the sound hole, the housing is provided with a baffle wall corresponding to the rear cavity, an air-permeable isolating member corresponding to the baffle wall is provided in the rear cavity, the baffle wall is matched with the air-permeable isolating member to separate a part from the rear cavity to form an independent cavity, and a sound absorbing material is filled in the independent cavity. The air-permeable isolating member is provided with a protrusion portion extending outwardly towards a direction away from the independent cavity.

7 Claims, 4 Drawing Sheets

A–A

SPEAKER BOX

TECHNICAL FIELD

The present disclosure relates to electroacoustic conversion technologies, and more particularly, to a speaker box.

BACKGROUND

In recent years, with a rapid development of mobile communication technology, mobile communication equipment with voice functions are increasingly used by consumers, such as portable telephones, handheld game machines and portable computers. Quality for designing a speaker box as a voice playing device directly affects a voice performance of mobile communication equipment products. In order to meet a market demand for thinness and higher sound quality, higher requirements are put forward for designing the speaker box.

In related technologies, the speaker box includes a housing with an accommodating space and a sound unit. The sound unit divides the accommodating space into a front cavity and a rear cavity. The rear cavity is provided with an independent cavity filled with a sound absorbing material, an isolating member is generally arranged at an opening end of the independent cavity to prevent the sound absorbing material from entering the rear cavity. The isolating member is generally a flat plate structure, and due to an irregular shape of the speaker box, a space of the rear cavity is not fully utilized.

Therefore, it is necessary to provide a new speaker box to solve the limitations above.

BRIEF DESCRIPTION OF THE DRAWINGS

In order to illustrate technical solutions in embodiments of the present disclosure more clearly, drawings used in the description of the embodiments will be briefly described below. Obviously, the drawings in the following description are merely some embodiments of the present disclosure. Those of ordinary skills in the art can also obtain other drawings according to these drawings without any creative work, where.

DETAILED DESCRIPTION

The following clearly and completely describes technical solutions in embodiments of the present disclosure with reference to accompanying drawings in the embodiments of the present disclosure. Apparently, the described embodiments are merely some but not all of the embodiments of the present disclosure. Based on the embodiments of the present disclosure, all other embodiments obtained by those of ordinary skills in the art without any creative work shall fall within the scope of protection of the present disclosure.

Figure 1:
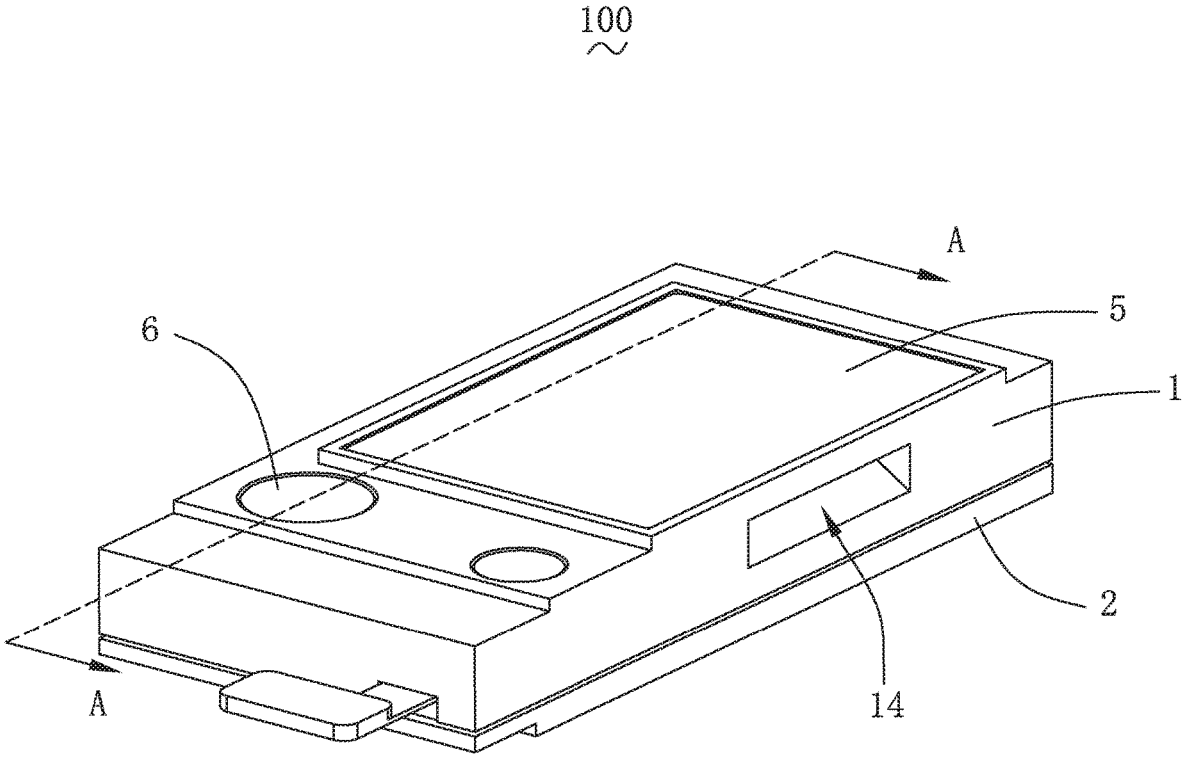
FIG. 1 is a perspective structure view of a speaker box in the present disclosure.
Figure 2:
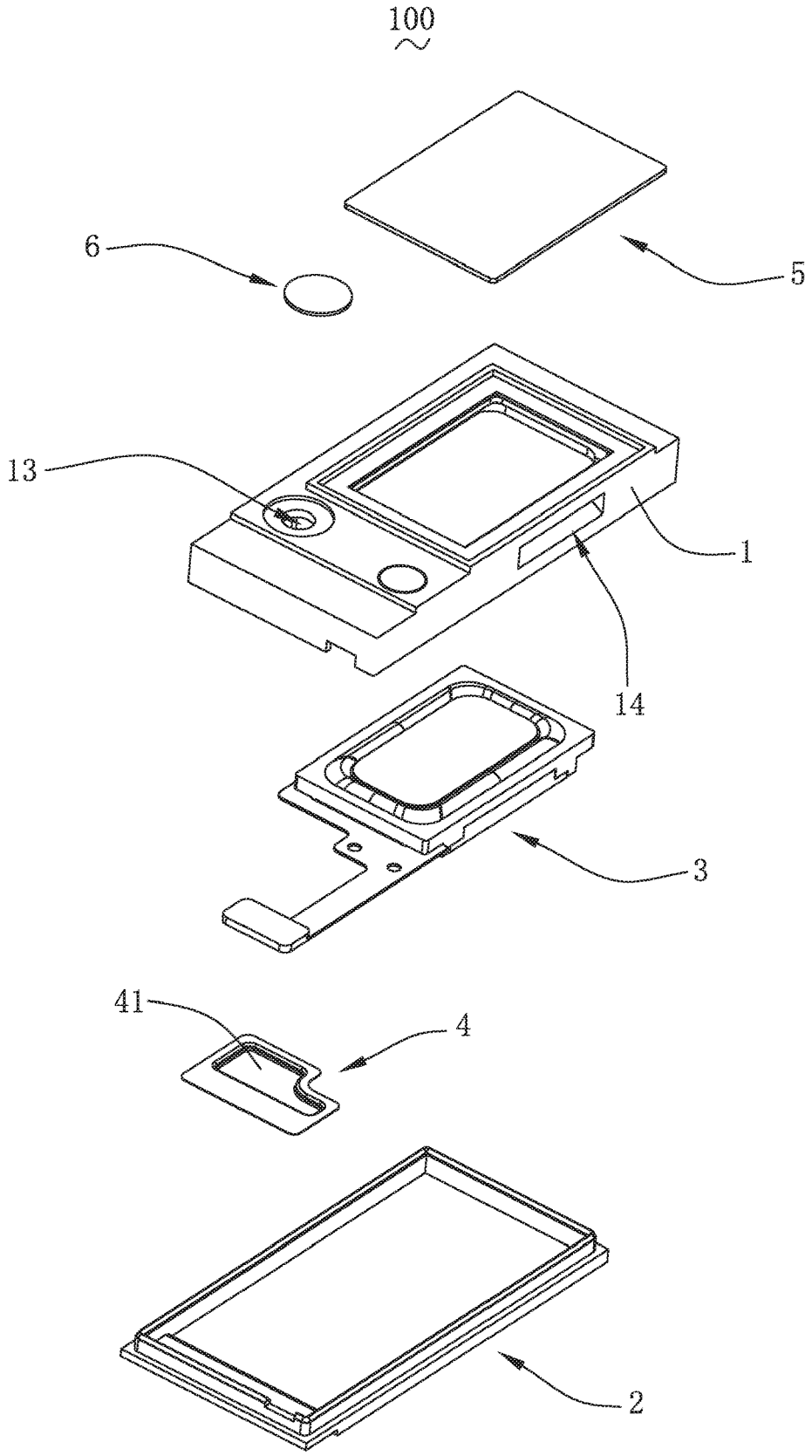
FIG. 2 is an exploded perspective view of the speaker box.
Figure 3:
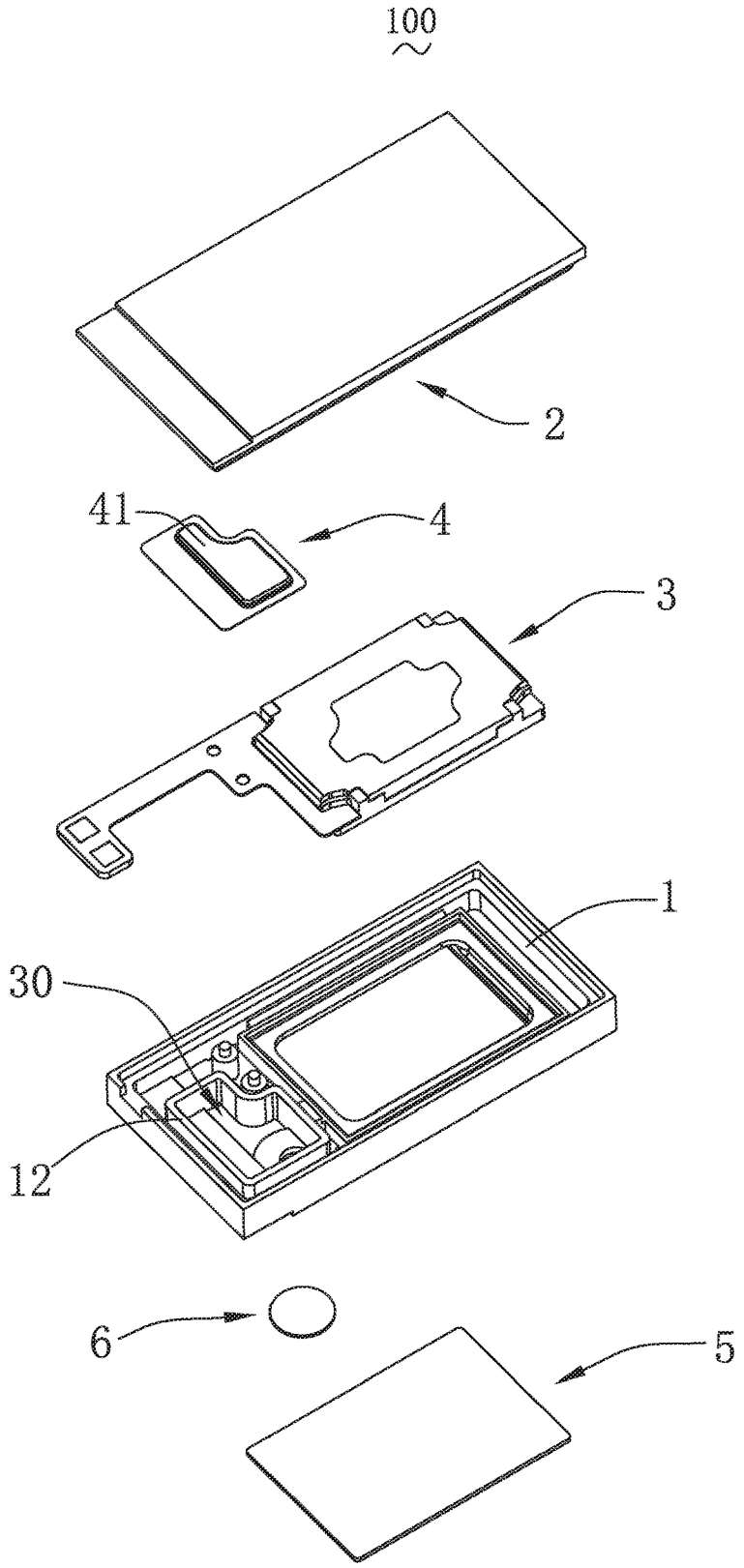
FIG. 3 is an exploded perspective view of the speaker box from another angle.
Figure 4:
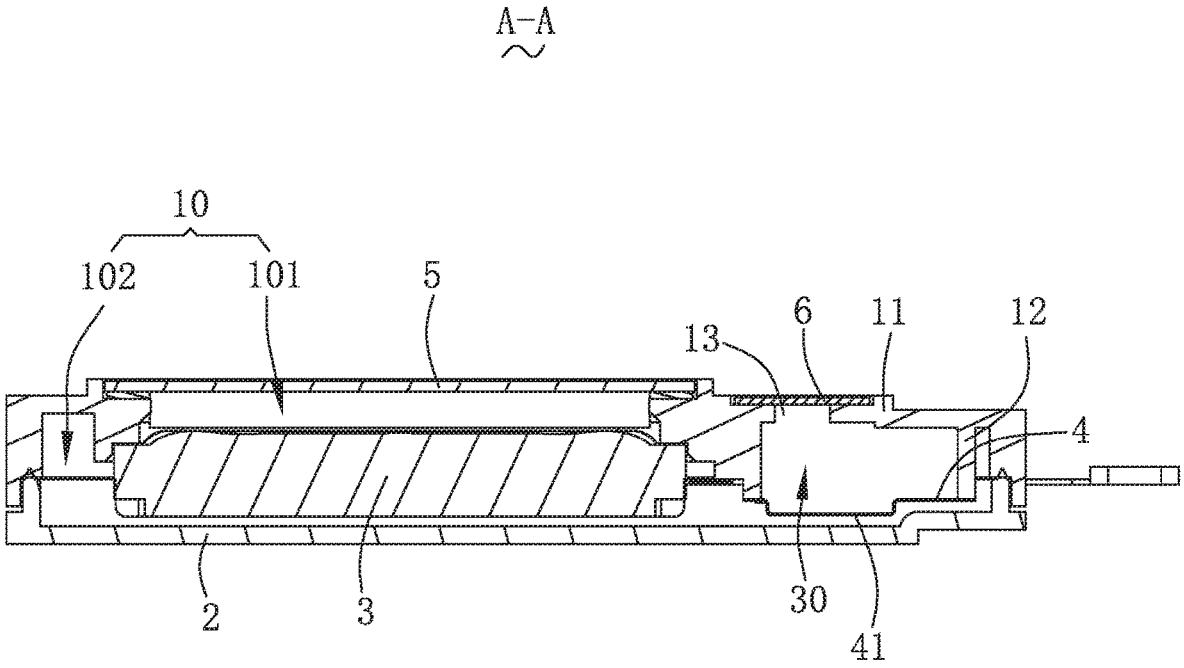
FIG. 4 is a sectional view along a line A-A in FIG. 1.

With reference to FIG. 1 to FIG. 4 at the same time, the present disclosure provides a speaker box 100, which includes an upper cover 1, a lower cover 2, a sound unit 3, an air-permeable isolating member 4, a steel sheet 5 and a sealing member 6.

The upper cover 1 is covered on the lower cover 2 and matched with the lower cover 2 to define an accommodating space 10, the sound unit 3 is accommodated in the accommodating space 10 and divides the accommodating space 10 into a front cavity 101 and a rear cavity 102. Specifically, the sound unit 3 and the upper cover 1 define the front cavity 101, and the sound unit 3, the lower cover 2 and the upper cover 1 define the rear cavity 102 together. In this embodiment, the upper cover 1 is provided with the steel sheet 5 at a position facing to the sound unit 3, the steel sheet 5 is covered on the upper cover 1, and the sound unit 3 and the steel sheet 5 are disposed separately to define the front cavity 101. The steel sheet has a large structure strength and can be made very thin to increase a volume of the front cavity, the steel sheet 5 and the upper cover 1 can be integrally injection-molded to form a sealing state, the sealing state can alternatively be formed by attaching and fixing the steel sheet 5 to the top of the upper cover 1, and certainly, the upper cover 1 may alternatively be a structure without the steel sheet 5. The upper cover 1 is further provided with a sound hole 14, and the front cavity 101 is communicated with the sound hole 14 for sounding.

The upper cover 1 includes a top wall 11 and a baffle wall 12 extending from the top wall 11 towards the lower cover 2, the baffle wall 12 is matched with the top wall 11 to define an independent cavity 30 with an opening, the opening faces to the lower cover 2, and a sound absorbing material is filled in the independent cavity 30, which can effectively improve a low-frequency acoustic performance of the speaker box 100. Preferably, the top wall 11 and the baffle wall 12 are an integral injection-molded structure.

The air-permeable isolating member 4 is located in the rear cavity 102, covered and fixed on one side of the baffle wall 12 close to the lower cover 2 to seal the opening, and matched with the top wall 11 and the baffle wall 12 to separate a part from the rear cavity 102 to form the independent cavity 30. The air-permeable isolating member 4 is provided with a protrusion portion 41 extending outwardly towards a direction away from the independent cavity 30, that is, the protrusion portion 41 extends outwardly towards a direction close to the lower cover 2, the protrusion portion 41 fully utilizes a space of the rear cavity to increase a volume of the independent cavity, so as to increase a filling amount of the sound absorbing material. In addition, a side surface of the protrusion portion 41 can further increase an air permeability, thus improving an acoustic performance.

The air-permeable isolating member 4 and the baffle wall 12 can be injection-molded or bonded with an adhesive.

Optionally, the air-permeable isolating member 4 is a non-woven fabric isolating member, and the protrusion portion 41 is formed by a thermoplastic process. Alternatively, the air-permeable isolating member 4 is a metal isolating member, and the protrusion portion 41 is formed by a stamping process. Certainly, the air-permeable isolating member 4 can alternatively be made of other materials, which is not limited by the present disclosure.

The upper cover 1 further includes a filling hole 13 penetrating through the top wall 11, and the sealing member 6 is covered in the filling hole 13. In this embodiment, the sound absorbing material is filled in the independent cavity 30 through the filling hole 13, and then the filling hole 13 is sealed with the sealing member 6 to complete a filling operation. Preferably, the sealing member 6 is a PET isolating member.

It should be noted that in the embodiment, the speaker box 100 is placed horizontally with a sound side of the sound unit facing upwardly. At the moment, an upper side of the upper cover 1 is defined as the top, and an orientation of other components refers to that of the upper cover 1.

Compared with related technologies, the air-permeable isolating member of the speaker box in the present disclosure is provided with the protrusion portion extending outwardly towards the direction away from the independent cavity, the protrusion portion fully utilizes the space of the rear cavity to increase the volume of the independent cavity, so as to improve the filling amount of the sound absorbing material. In addition, the side surface of the protrusion portion can further increase the air permeability, thus improving the acoustic performance.

The description above is merely embodiments of the present disclosure, and it should be pointed out that, those of ordinary skills in the art can make improvements without departing from the inventive concept of the present disclosure, but these all belong to the scope of protection of the present disclosure.

What is claimed is:

1. A speaker box, comprising a housing with an accommodating space and a sound unit accommodated in the housing, wherein the sound unit divides the accommodating space into a front cavity and a rear cavity, the housing is provided with a sound hole, and the front cavity is communicated with the sound hole, wherein the housing is provided with a baffle wall corresponding to the rear cavity, an air-permeable isolating member corresponding to the baffle wall is provided in the rear cavity, the baffle wall is matched with the air-permeable isolating member to separate a part from the rear cavity to form an independent cavity, and a sound absorbing material is filled in the independent cavity, wherein the air-permeable isolating member is provided with a protrusion portion extending outwardly towards a direction away from the independent cavity.

2. The speaker box according to claim 1, wherein the air-permeable isolating member is a non-woven fabric isolating member, and the protrusion portion is formed by a thermoplastic process.

3. The speaker box according to claim 1, wherein the air-permeable isolating member is a metal isolating member, and the protrusion portion is formed by a stamping process.

4. The speaker box according to claim 1, wherein the housing is provided with a filling hole corresponding to the independent cavity, the sound absorbing material is injected into the independent cavity through the filling hole, and a sealing member is arranged at the filling hole to seal the sound absorbing material in the independent cavity.

5. The speaker box according to claim 4, wherein the sealing member is a PET isolating member.

6. The speaker box according to claim 1, wherein the housing comprises a lower cover and a upper cover assembled with the lower cover to define the accommodating space, the baffle wall is formed by extending the upper cover towards the lower cover, the sound unit and the upper cover define the front cavity, the sound unit, the lower cover and the upper cover define the rear cavity together, and the air-permeable isolating member is covered and fixed on one side of the baffle wall close to the lower cover and define the independent cavity together with the baffle wall and the upper cover.

7. The speaker box according to claim 6, wherein the baffle wall and the upper cover are integrally injection-molded.

* * * * *